United States Patent [19]

Caruthers et al.

[11] Patent Number: 5,051,329

[45] Date of Patent: Sep. 24, 1991

[54] REVERSAL DEVELOPMENT OF LATENT ELECTROSTATIC IMAGES ON XEROPRINTING MASTERS

[75] Inventors: Edward B. Caruthers, West Chester; Michael L. Levin, Downingtown, both of Pa.; Catharine E. Looney, Centerville, Del.; Steven P. Schmidt, Chester Springs, Pa.; Dana S. Smith, Wilmington, Del.

[73] Assignee: DXImaging, Lionville, Pa.

[21] Appl. No.: 452,994

[22] Filed: Dec. 19, 1989

[51] Int. Cl.[5] ..... G03G 13/10

[52] U.S. Cl. ..... 430/100; 430/119

[58] Field of Search ..... 430/100, 122, 119

[56] References Cited

U.S. PATENT DOCUMENTS

| | | | |
|---|---|---|---|
| Re. 29,357 | 8/1977 | Brickmore et al. | 430/31 |
| 2,990,280 | 6/1961 | Giaimo | 430/31 |
| 3,560,203 | 2/1971 | Honjo et al. | 96/1 |
| 3,655,419 | 4/1972 | Tamai et al. | 117/17.5 |
| 3,772,012 | 11/1973 | Whittaker | 96/1 LY |
| 3,888,666 | 6/1975 | Matsumoto et al. | 96/1 R |
| 4,286,036 | 8/1981 | Hendriksma | 430/100 |
| 4,436,802 | 3/1984 | Ohtsuka et al. | 430/100 |
| 4,468,110 | 8/1984 | Tanigawa et al. | 355/3 TR |
| 4,659,211 | 4/1987 | Oka | 355/14 D |

*Primary Examiner*—John Goodrow

[57] ABSTRACT

Process for reversal development of a latent electrostatic image in a layer on a conductive support by developing with an electrostatic developer having electrostatically charged toner particles by (a) generating imagewise areas in the layer having different rates of charge decay and/or charge acceptance, (b) charging the layer, (c) allowing formation of an electrostatic image corresponding to the imagewise generated areas by differential charge decay and/or charge acceptance, (d) creating an electrical field to attract toner particles preferentially to the areas of lesser charge, and (e) developing the areas of lesser charge with electrostatically charged toner particles having the same polarity as that of the charged layer.

The developed image can be transferred to a receptor surface, e.g., paper. The process is useful with many type photosensitive masters in preparing reversal images with the use of only one master, toner and film original.

29 Claims, No Drawings

REVERSAL DEVELOPMENT OF LATENT ELECTROSTATIC IMAGES ON XEROPRINTING MASTERS

DESCRIPTION

1. Technical Field

This invention relates to a process for the reversal development of latent electrostatic images. More particularly, this invention relates to a reversal development process wherein the latent image is formed in a photohardenable, leuco dye containing photosensitive, washout photohardenable, or silver halide salt-based electrostatic element.

2. Background of the Invention

Xeroprinting masters are elements with an image or pattern of low conductivity material on a conduct support. Typically the image has been produced by exposure of the element to actinic radiation through a film original, in some cases followed by chemical processing. Charging the element, for example by corona discharge, produces an electrostatic image corresponding to the image or pattern of the low conductivity material. The electrostatic image is developed by toning with oppositely charged toner particles, and the toned image can be transferred electrostatically or by other means to a receptor such as paper or film. Either dry or liquid developers can be used.

The image or pattern of low conductivity material in the xeroprinting master is permanent or persistent, so after transfer of toner to a receptor, such as paper, the master can be returned for a second printing cycle. Multiple charge, tone, transfer cycles, and thus multiple copies on receptors, can be made from a single exposure or imaging step. This multiple printing capability distinguishes xeroprinting masters from photoconductors commonly used in electrophotography, The functionality of xeroprinting masters in electrography depends on rates of decay and/or acceptance of electrostatic charge in certain regions being different from rates in other regions. The different relative rates are manifestations of chemical differences between the two regions (imaged and non-imaged) inherent in xeroprinting masters. These differences distinguish xeroprinting masters from photoconductors wherein imaged regions are not chemically different from non-imaged regions. Both differences in rates of charge decay and differences in rates of charge acceptance between imaged and non-imaged regions manifest themselves in differences in electrostatic charge in those regions.

A number of xeroprinting masters have been developed. In some, regions of low conductivity correspond to imaged areas; in others, regions of low conductivity correspond to non-imaged areas. With certain photopolymerizable (photohardenable) elements, for example, exposure creates areas of reduced conductivity. These elements will be referred to as "negative-working." With certain silver halide salt-based elements, on the other hand, exposure and processing creates areas of enhanced conductivity. These elements will be referred to as "positive-working." When xeroprinting masters are used conventionally, as described above in the first paragraph of this section, the regions of low conductivity, i.e., regions with the slower rate of charge decay or higher rate of charge acceptance, retain electrostatic charge and hence attract oppositely charged electrostatic toner. The resulting toned images are thus images of the regions of low conductivity. To produce desirable toned and printed positives, however, a xeroprinting master is limited to use with a single type of film original (positive vs. negative). Using a photopolymerizable element as a xeroprinting element, for example, a negative film original is required; alternately using a silver halide salt-based element, e.g., as described above, a positive film original is required. To obtain a printed positive from a negative film and a positive-working master, or from a positive film and a negative-working master, would require an intermediate photoreversal step and the necessity of producing a second film for use in exposure of the xeroprinting element.

It is desirable to directly produce toned images which are photoreversals of those described above without the need for creating a second film original. This would allow production of printed positives directly from positive film originals as well as from negative film originals. For xeroprinting masters, such a reversal requires toning of the areas of the element having lesser charge rather than the areas having greater charge as in conventional use. Such a reversal would enable the generation of a positive-to-positive imaging system utilizing the same masters and toners to be used for a negative-to-positive conventional process, or would enable a negative-to-positive imaging system utilizing the same masters and toners to be used for a positive-to-positive conventional system.

The process of the invention allows for the generation of both positive and negative images using a single electrostatic master and toner and either a positive or negative film original.

SUMMARY OF THE INVENTION

In accordance with this invention there is provided a process for reversal development of a latent electrostatic image in a layer on a conductive support by developing with an electrostatic developer having electrostatically charged toner particles by (a) generating imagewise areas in the layer having different rates of charge decay and/or charge acceptance,
(b) charging the layer,
(c) allowing formation of an electrostatic image corresponding to the imagewise generated areas by differential charge decay and/or charge acceptance,
(d) creating an electrical field to attract toner particles preferentially to the areas of lesser charge, and
(e) developing the areas of lesser charge with electrostatically charged toner particles having the same polarity as that of the charged layer.

DETAILED DESCRIPTION OF THE INVENTION

According to the invention with reversal development, the same xeroprinting electrostatic elements or masters and the same toners can be used to produce positive toned images and thus positive prints from either positive or negative film originals. Without reversal development two different masters would be required to be able to print positives from either film original, or secondary films would have to be created.

In conventional use areas of low conductivity, areas which retain electrostatic charge, are developed. Toned density uniformity is dependent on electrostatic charge uniformity, which in turn is dependent on material and system uniformity. With reversal development, however, areas with little or no electrostatic charge, are developed. Uniformity in toned density is not dependent on uniformity of charge in the low conductivity regions.

In the process for reversal development of the invention the latent electrostatic image may be present in a layer that is photohardenable, leuco dye-containing photosensitive, wash-out photohardenable, or silver halide-based electrostatic element. Other elements not exemplified here may be used provided they are capable of generating imagewise areas having different rates of charge decay and/or charge acceptance.

The photohardenable electrostatic element or master comprises a photohardenable layer on a conductive support. A cover sheet, e.g., plastic film, may be present on the photohardenable layer. The photohardenable (photopolymerizable) layer of the electrostatic element consists essentially of at least one organic polymeric binder, at least one compound having at least one ethylenically unsaturated group which can be a monomer, a photoinitiator or photoinitiator system, optionally a chain transfer agent as well as other additives, and optionally either (1) at least one organic electron donor, also known as p-type conducting compound or at least one organic electron acceptor, also known as an n-type conducting compound as described in Blanchet-Fincher et al. U.S. Pat, No. 4,849,314, or (2) a substituted aromatic amino compound, and preferably a strong acid as described in Blanchet-Fincher, Fincher, Cheung, Dessauer and Looney, U.S. Pat. No. 4,818,660. Preferably the chain transfer agent is present. Photohardenable electrostatic elements with improved environmental latitude are disclosed in Blanchet-Fincher and Chang, U.S. Ser. No. 351,361, filed May 12, 1989.

Throughout the specification the below-listed term has the following meaning:

"Consisting essentially of" as used in this specification and claims means that there can be present in the photohardenable layer, in addition to the primary ingredients, other ingredients which do not prevent the advantages of the invention from being achieved. These other ingredients which can also be present are set out below. Polymeric binders, ethylenically unsaturated compounds, photoinitiators, including preferred hexaarylbiimidazole compounds (HABI's) and chain transfer agents are disclosed in Chambers U.S. Pat. No. 3,479,185, Baum et al. U.S. Pat. No. 3,652,275, Cescon U.S. Pat. No. 3,784,557, Dueber U.S. Pat. No. 4,162,162, and Dessauer U.S. Pat. No. 4,252,887, the disclosures of each of which, as well as the two U.S. patents and one U.S. patent application set out above, are incorporated herein by reference.

Positive working electrostatic elements having a photosensitive layer, specifically a leuco dye containing photosensitive layer, on a conductive support are disclosed in Kempf, Dessauer and Fröelich, U.S. Ser. No. 07/374491, filed June 30, 1989 now U.S. Pat. No. 4,945,020, the disclosure of which is incorporated herein by reference.

Photohardenable wash-out layers, for example, that may be coated on or laminated to a conductive support to form an electrostatic master are disclosed in Chen U.S. Pat. No. 4,323,636, Chen and Brennan U.S. Pat. No. 4,323,637, Fan U.S. Pat. No. 4,072,527, Bratt U.S. Pat. No. 4,072,528, and Alles U.S. Pat. No. 3,458,311, the disclosures of which are incorporated herein by reference.

The silver halide salt-based electrostatic element are disclosed in Cairncross, U.S. Pat. No. 4,868,081 the subject matter of which is incorporated herein by reference. This patent discloses a photosensitive composition consisting essentially of a silver halide photographic salt dispersed in a synthetic insulating polymeric binder that is swellable in aqueous solutions having a pH greater than about 8½, said composition having an insulating value such that it will support a macroscopic electric field of at least approximately 5 volts/μm as measured 2 seconds following full charging of its surface that has been allowed to equilibrate at 50% relative humidity for 1 hour.

The photohardenable (photopolymerizable), and wash-out photohardenable elements are exposed imagewise by actinic radiation whereby the exposed areas become hardened or polymerized generating imagewise areas having different rates of charge decay and/or charge acceptance. Suitable radiation depends on the sensitivity of the particular photopolymerizable layer composition used to form the photopolymerizable layer. Generally standard ultraviolet energy sources are used. If, however, the photopolymerizable composition is sensitive to visible light then that type of exposure source can be used. Exposure sources can also be of the laser type. The exposing radiation can be modulated either by digital or analog means. Analog exposure utilizes a line or half-tone negative or other pattern interposed between the radiation source and photopolymerizable layer. Digital exposure is by means of a computer controlled visible light-emitting laser which can scan the film in raster fashion. For digital exposure a high speed photopolymerizable element is utilized, e.g., one containing a high-level of hexaarylbiimidazole photoinitiator, chain transfer agent and sensitized to higher wavelength light with a sensitizing dye.

The silver halide salt-based electrostatic element is exposed imagewise using any of the procedures commonly used with silver halide photographic materials, such as by imaging with actinic light, cathode ray tube, or laser. In the case of films consisting of silver halide grains dispersed in an insulating binder, the latent image is then developed by reducing the exposed silver halide particles to metallic silver using conventional aqueous developing solutions. A conventional aqueous fixing solution, such as sodium thiosulfate, is then used to remove the unexposed silver halide particles. The developed element having imagewise areas having different rates of charge decay and/or charge acceptance is then ready for the electrostatic printing process. In the case of diffusion transfer silver halide films, the latent image is developed to give silver metal in the silver halide emulsion layer and unexposed silver halide is dissolved with complexing agents. The complexed unexposed silver halide then diffuses into the underlying insulating polymer layer which contains development nuclei, wherein the silver ions are reduced to silver metal on the development nuclei. The emulsion layer is then removed by washoff processing to give an electrostatic master ready for printing.

The leuco dye containing photosensitive layer is exposed to radiation of wavelength in the 200 to 500 nm range preferably about 310 to about 400 nm, and most preferably about 360 nm. Any convenient source of ultraviolet/visible light may be used to activate the light-sensitive composition and induce the formation of an image. In general, light sources that supply radiation in the region between about 2000 Å and about 5000 Å are useful in producing images. Among the light sources which can be employed are sun lamps, electronic flash guns, germicidal lamps, carbon arcs, mercury-vapor arcs, fluorescent lamps with ultraviolet emitting phosphors, argon and xenon glow lamps, electronic flash units, photographic flood lamps, ultraviolet lamps providing specifically light of short wavelength (2537 Å) and lamps providing light of long wavelength (4500 Å). The light exposure time will vary from a fraction of a second to several minutes depending upon the intensity of the light, its distance from the photosensitive composition, the opacity of the phototool, and the nature and amount of the photosensitive composition. There may also be used coherent light beams, for example, pulsed nitrogen lasers, argon ion lasers and ionized Neon II lasers, whose emissions fall within or overlap the ultraviolet absorption bands of the HABI. Visible light emitting lasers such as argon ion, krypton ion, helium-neon, and frequency doubled YAG lasers may be used for visibly sensitized photosensitive layers.

Ultraviolet emitting cathode ray tubes widely useful in printout systems for writing on photosensitive materials are also useful for imaging the subject compositions. These in general involve a UV-emitting phosphor internal coating as the means for converting electrical energy to light energy and a fiber optic face plate as the means for directing the radiation to the photosensitive target. For purposes of this invention, the phosphors should emit strongly below 420 nm (4200 Å) so as to substantially overlap the near UV-absorption characteristic of the photosensitive compositions of the invention. Representative phosphors include the P4B (emitting at 300–550 nm, peaking at 410 nm), P16 (330–460 nm, peaking at 380 nm) and P22B (390–510 nm, peaking at 450 nm) types. Electronic Industries Association, New York, NY assigns P-numbers and provides characterizing information on the phosphors; phosphors with same P-number have substantially identical characteristics.

Prior to or after the imagewise exposure the cover sheet, if present, can be removed by stripping or peeling as is known to those of ordinary skill in the art.

After the imagewise areas having different rates of charge decay and/or charge acceptance have been generated in the photohardenable, wash-out photohardenable, leuco dye-containing photosensitive or silver halide salt-based electrostatic element, the layer containing the imagewise generated areas is electrostatically charged, and then allowed to form an electrostatic image corresponding to the imagewise generated areas. The elements may be allowed to stand for 0.001 to 10.0 minutes, preferably 0.01 to 0.25 minute to differentially discharge, depending on the nature of the xeroprinting element. The preferred electrostatic charging means is corona discharge via a scorotron. Alternatively, charging can be accomplished with the use of a shielded corotron, radioactive source, contact electrodes such as electrically biased semiconductive rubber rollers, and the like.

An electrical field is then created to attract toner particles preferentially to the areas of lesser charge. When the imagewise areas in the layer having different rates of charge acceptance are generated and the layer is charged, the electrical field may be created immediately thereafter. For controlled development of electrostatic images a development electrode, typically a conductive plate or a conductive roll parallel and close to the xeroprinting element, is employed.

In conventional charged area development the development electrode is maintained at a potential which is of the same sign but small relative to the potential of the charged areas of the xeroprinting element. A toner is employed which has a charge of opposite sign from the charge of the element. Toner present in the field between the element and the development electrode is thus attracted to the areas of greater charge of the element.

In reversal development, however, the xeroprinting element is charged with the same polarity as the charge of the toner to be used. An electric field is created between the development electrode and the xeroprinting element by applying a voltage bias to either the development electrode or the conductive backing of the xeroprinting element. The voltage is adjusted to produce a potential on the electrode less than the potential on the element in charge retaining areas but greater than the potential in the discharged areas. In insulating, charge-retaining areas no development of the xeroprinting element occurs. However, the field created between the electrode and the element in areas of the element of lesser charge attracts toner to the xeroprinting element in these areas.

The areas of lesser charge are then developed by means of an electrostatic dry toner or liquid electrostatic developer, the latter being preferred. Dry electrostatic toners are known to those skilled in the art. Known electrostatic liquid developers and known methods of developer application can be used. Preferred liquid electrostatic developers are suspensions of pigmented resin toner particles in nonpolar liquids which are generally charged with charge director compounds, e.g., ionic or zwitterionic compounds. The nonpolar liquids normally used are the Isopar® branched-chain aliphatic hydrocarbons (sold by Exxon Corporation) which have a Kauri-butanol value of less than 30 and optionally containing various adjuvants as described in Mitchell U.S. Pat. Nos. 4,631,244 and 4,663,264, Taggi U.S. Pat. No. 4,670,370, Larson and Trout U.S. Pat. No. 4,681,831, El-Sayed and Taggi U.S. Pat. No. 4,702,984, Larson U.S. Pat. No. 4,702,985, Trout U.S. Pat. No. 4,707,429, and Mitchell U.S. Pat. No. 4,734,352. The disclosures of these patents are incorporated herein by reference. The above nonpolar liquids are narrow high-purity cuts of isoparaffinic hydrocarbon fractions with the following boiling ranges: Isopar®-G 157°–176° c.; Isopar®-H 176°–191° C.; Isopar®-K 177°–197° C.; Isopar®-L 188°–206° C.; Isopar®-M 207°–254° C.; Isopar®-V 254°–329° C. Other known hydrocarbon liquids can be used as well. Preferred resins of the liquid electrostatic developers are copolymers of ethylene (80 to 99.9%)/acrylic or methacrylic acid (0 to 20.0%)/alkyl of acrylic or methacrylic acid where alkyl is 1 to 5 carbon atoms (0 to 20%), e.g., copolymers of ethylene (89%) and methacrylic acid (11%) having a melt index at 190° C of 100. Other resins disclosed in the above United States patents are also useful. The disclosure relating to resins from these patents is incorporated herein by reference. The resin toner particles preferably have an average particle size of (by area) less than 10 μm, as measured by a Horiba CAPA-500 centrifugal particle analyzer, Horiba Instruments, Inc., Irvine, Calif. Preferred nonpolar liquid soluble ionic or zwitterionic components which in general afford negatively charged toner, are lecithin and Basic Barium Petronate® oil-soluble petroleum sulfonate manufactured by Sonneborn Division of Witco Chemical Corp., New York, N.Y., Emphos® anionic glycerides, sodium salts of mono- and diglycerides with saturated and unsaturated acid substituents, also manufactured by Witco Chemical Corp., NY, N.Y. Many of the monomers useful in the photohardenable composition are soluble in these Isopar® hydrocarbons, especially in Isopar®-L, as well as other nonpolar liquids. Consequently, repeated toning with Isopar® based developers to make multiple copies can deteriorate the electrical properties of the master by extraction of monomer from unexposed areas. The preferred monomers are relatively insoluble in Isopar® hydrocarbons, and extended contact with these liquids does not unduly deteriorate films made with these monomers. Photopolymerizable electrostatic elements made with other, more soluble monomers can still be used to make multiple copies, using liquid developers having a dispersant with less solvent action.

After toning with dry toner developers or developing with liquid electrostatic developer the developed image can be transferred to another surface or receptive support, such as paper, for the preparation of an image. Other receptor supports include, but are not limited, to polymeric films, cloth or other printable materials and surfaces. For making integrated circuit boards, the transfer surface can be an insulating board on which conductive circuit lines can be printed by this process, or it can be an insulating board covered with a conductor, e.g., a fiber glass board covered with a copper layer, on which a resist is printed by this process. Transfer is accomplished by electrostatic or other means, e.g., by contact with an adhesive receptor surface or applying pressure and heat, or a combination of these methods. Electrostatic transfer can be accomplished in any known manner, e.g., by placing the receptive support on a conductive cylinder and bringing the toned surface within 0.002 to 0.1 inch (0.05 to 2.54 mm) of the paper, the gap being filled with Isopar® hydrocarbon. When negatively charged toner particles are used, a positive potential is applied to the conductive cylinder, driving the toner particles of the developer off the photohardenable electrostatic master onto the receptive support, e.g., paper. Alternately, the paper may be placed in contact with the developed image using a tackdown roll or corona which when held at negative voltages ill press the two surfaces together assuring intimate contact. After tackdown a positive corona discharge is applied to the backside of the paper driving the toner particles of the developer off the photohardenable electrostatic master onto the paper. In the case of positively charged toners, polarities opposite to that described above are used to effect tone transfer. In making multiple images from a single imagewise exposed photohardenable electrostatic master, it is only necessary to repeat the steps of charging electrostatically, toning and transferring. Each transfer requires a separate receptor support or surface.

INDUSTRIAL APPLICABILITY

The reversal process is particularly useful in the graphic arts industry, particularly in the area of color proofing wherein the proofs prepared duplicate the images achieved by printing. The process of the invention satisfies the proofing needs of all printers whether they work with positive or negative color separations because the process allows one master and one separation to produce both positive or negative images. The process is also useful in making integrated circuit boards and printing plates.

EXAMPLES

The following examples illustrate but do not limit the invention wherein the percentages are by weight.

EXAMPLE 1

An electrostatic printing master was prepared by dispersing a conventional silver halide emulsion in an insulating polymer and coating the mixture on a conductive substrate in a manner similar to that described in Example 12 of Cairncross U.S. Pat. No. 4,868,081 with the exception that the insulating binder contained "Polymer E" (Example 5 of U.S. Pat. No. 4,868,081) and indium tin oxide coated polyester was used as the substrate. The film was contact exposed through a high resolution positive phototool and tray processed (develop, fix, stop, rinse and dry) as described in Example 12 of U.S. Pat. No. 4,868,081. The resultant image consisted of conductive silver areas where the film was exposed (background areas) and insulating silver-free areas where the film was unexposed.

The film was mounted on a flat aluminum plate and an electrical connection between the conductive indium tin oxide (ITO) substrate of the master and the aluminum plate was made with the use of conductive copper foil tape (Chomerics, Inc., Hudson, NH). The aluminum plate was then electrically connected to a DC power supply. With the master grounded through the power supply, the film was corona charged with a 12 inch (30.48 cm) long, single wire corotron operated at +6 kV. A second parallel aluminum plate was mounted above the charged master to serve as a development electrode. The two aluminum plates were separated by a spacing of 0.075 inch (0.1905 cm) with insulating posts. The plate with the master (and hence the ITO substrate) was biased with −50 V. The development electrode was biased with −20 V (optional). The assembly was then placed in a plastic tray containing a positively charged liquid electrostatic toner (James River Graphics T1818) for a period of 3 seconds, after which the plates were removed from the bath and excess toner allowed to drain. The plates were separated and the biases turned off. Toner was found to have preferentially deposited on the conductive portions (exposed areas) of the master. Toner was then electrostatically transferred from the master to paper with the use of a bias roll operated at −1 kV. The toner image was then dried and fused on the paper at approximately 100° C. in an oven.

EXAMPLE 2

An electrostatic master was prepared from a silver halide diffusion transfer film coated on a conductive substrate (ITO described in Example 1) in a manner similar to that described in Example 29 of Cairncross, U.S. patent application 07/196,803 filed May, 16, 1988, now U.S. Pat. No. 4,868,081 with the exception that the insulating binder contained "Polymer E" (Example 5 of U.S. patent application 07/196,803). The film was contact exposed through a negative phototool and tray processed (develop, stop, wash-off silver halide emulsion layer, rinse and dry) in a manner similar to that described in Example 29 of U.S. application 07/196,803, now U.S. Pat. No. 4,868,081 with the exception that the developer contained an additional 12.5% by weight potassium hydroxide. The resultant image consisted of conductive silver areas where the film was unexposed and electrically insulating silver-free areas where the film was exposed.

The film was mounted on an aluminum drum and the drum, in turn, mounted in a modified Savin 870 copier. An electrical connection was made between the conductive substrate (ITO) of the master and a DC power supply. With the master grounded through the power supply, the film was corona charged with the corotron operated at −6 kV. After charging, the substrate of the master was biased with +20 V. The development electrode was maintained at ground potential. Rotation of the drum bearing the master (2 rpm) through the development station containing negatively charged liquid electrostatic toner pigmented with carbon black similar to that described in Control 1 of Mitchell, U.S. Pat. No. 4,631,244, resulted in a developed image with the developer preferentially deposited on the conductive silver areas (unexposed areas) of the master. The developer was transferred to paper via a bias roll operated at +750 V. The developed image was then dried and fused on the paper at approximately 100° C. in an oven.

EXAMPLE 3

A CitiPlate® master (washoff photopolymer on a flexible aluminum substrate) was mounted in a modified Savin 870 copier as described in Example 2. With the aluminum substrate grounded, the master was corona charged (corotron operated at −6 kV). A bias of +25 V was then applied to the substrate. The development electrode was maintained at ground potential. Rotation of the drum bearing the master (2 rpm) through the toning station containing negatively charged black liquid electrostatic toner similar to that described in Example 2 gave a developed image with developer preferentially deposited on the bare aluminum areas (unexposed areas where photopolymer was washed off) of the master. The developed image was transferred to paper with the use of a bias roll operated at +550 V. The image was then dried and fused on the paper at approximately 100° C. in an oven.

EXAMPLE 4

A photopolymerizable composition consisting of 57.0% poly(styrene/methylmethacrylate)(70/30), 28.6% ethoxylated trimethylolpropane triacrylate, 10.6% 2.2',4,4'-tetrakis(o-chlorophenyl)-5,5'-bis(m,p-dimethoxyphenyl)-biimidazole, and 3.8% 2-mercaptobenzoxazole was coated on a 0.004 inch (0.0102 cm) aluminized polyethylene terephthalate film substrate. A 0.00075 inch (0.0019 cm) polypropylene cover sheet was laminated to the dried photopolymerizable layer. The photopolymerizable element was exposed imagewise (for 4 integrated intensity units) through a halftone positive film with its emulsion side in contact with the cover sheet, using a Douthitt Option X exposure type 5027 lamp, Douthitt Corporation, Detroit, Mich. The aluminized substrate with the imaged photopolymerizable element was mounted on a flat plate and the cover sheet was then removed. The aluminized substrate was electrically grounded. The photopolymerizable element was then charged negatively by passing at 0.5 inch/sec (1.27 cm/sec) over a corotron operated at 4.25 kV. A positive potential of +200 V was then applied to the aluminized substrate, and the element was toned (approximately 30 seconds after charging) with negatively-charged black liquid electrostatic developer. A 0.04 inch (0.1016 cm) developer-filled gap between a flat development plate, held at electrical ground, and the charged photopolymerizable element, was used.

The black developer was prepared using the following procedure: In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, acid no. is 66 | 200 |
| Sterling ® NS carbon black Cabot Corp., Boston, MA | 25.6 |
| Heucophthal Blue G XBT-583D Heubach, Inc., Newark, NJ | 1.6 |
| Isopar ®-L, nonpolar liquid having a Kauri-butanol value of 27, Exxon Corp | 1000 |

The ingredients were heated to 100° C.–110° C. and milled at a rotor speed of 230 rpm with 0.1875 inch (4.76 mm) diameter steel balls for two hours. The attritor was cooled to room temperature while the milling was continued and then 700 grams of Isopar®-H, nonpolar liquid having a Kauri-butanol value of 27, Exxon Corporation, were added. Milling was continued at a rotor speed of 330 rpm for 19 hours to obtain toner particles with an average size of 1.5 μm by area. The particulate media were removed and the dispersion of toner particles then diluted to 2.0 percent solids with additional Isopar®-H. To 2000 grams of this dispersion were added 12 grams of a 10% solution of lecithin (Fischer Scientific, Pittsburgh, Pa.) in Isopar®-H.

A black toned image on the photopolymerizable element resulted. The toned image was optically positive reproduction of the original halftone positive film used in imaging the photopolymerizable element. The toned image had clean background areas, high image density (1.2–1.4 density units after drying), and halftone dots of 3–85% (150 line/inch screen).

EXAMPLE 5

The photopolymerizable element described in Example 4 was exposed imagewise (for 16 integrated intensity units) as described in Example 4 through a halftone positive film. The polyethylene terephthalate film substrate was mounted on a flat plate, and the cover sheet was then removed from the photopolymerizable element.

The imaged photopolymerized element was charged negatively by passing at 0.5 inch/second (1.27 cm/second) over a −4.0 kV corotron, the aluminized substrate being electrically grounded. The element was then toned (approximately 16 seconds after charging) with negatively-charged black liquid electrostatic toner described in Example 4, by passing over a flat development plate, using a 0.04 inch (0.10 cm) toner-filled gap between the charged photopolymerizable element and the development plate. In this example a negative potential (−25V) was applied to the development plate, while the aluminized substrate of the photopolymerizable element was held at electrical ground.

A black toned image on the photopolymerizable element resulted. The toned image was an optically positive reproduction of the original positive halftone films used to image the element. The toned image exhibited clean background areas and halftone dots of 2–85% (150 line/inch screen).

The toned image was electrostatically transferred to paper using a bias roll. Plainwell Solitaire offset enamel paper (Plainwell Co., Plainwell, Mich.) was wrapped around a metal drum to which +500 V was applied. The toned photopolymerizable element was spaced 0.006 inch (0.015 cm) from the paper, the gap being filled with Isopar ®-H. Transfer was carried out at 0.5 inch/second (1.27 cm/second). The paper was removed from the bias roll and was heated at 110° C. for 1 minute to fuse the toned image and fix it to paper. The image exhibited good solid area density of 1.2–1.4 density units.

EXAMPLE 6

A 4 inch (10.16 cm) by 5 inch (12.7 cm) sample of photosensitive film consisting of a metallized polyethylene terephthalate support, photosensitive layer, and a polypropylene cover sheet, as described in Kempt, Dessauer and Fröelich, U.S. patent application Ser. No. 07/374,591, filed June 30, 1989 entitled "Photosensitive Leucodye Containing Electrostatic Master With Print-out Image", now U.S. Pat. No. 4,945,020 was imagewise exposed for 20 seconds through a positive halftone film in emulsion to cover sheet contact in a vacuum frame exposure unit (Douthitt Model X with Theimer Violux ® lamp with photopolymer bulb and Kokomo glass 360 nm ultraviolet light bandpass filter, Douthitt Corp., Detroit, Mich.). The back surface of the film was affixed to a correspondingly sized flat plate of aluminum metal and the cover sheet removed. A small (0.25 inch (0.635 cm) ×1 inch (2.54 cm)) region of the photosensitive layer was removed with a cotton swab saturated with acetone to reveal the aluminum surface of the support substrate. This back surface contact to the photosensitive layer was electrically connected to the aluminum metal plate using a copper metal tape. The plate was in turn connected by a wire to earth ground and positioned into a parallel rail assembly which supported the side edges of the plate and held the planar surface at a fixed distance from the grid of an opposing multi-wire scorotron charging device. The grid of this was driven to a potential of −85 Volts and the wire portion to −5.08 kiloVolts. The plate bearing the film sample facing the charging device was moved by hand along the rails to negatively charge the surface of the film.

The plate was then quickly moved further along the rail assembly to position the film sample directly opposite a development electrode consisting of flat aluminum plate parallel to the film plane and spaced 0.007 inch (0.0178 cm) from the surface of the film. This electrode was driven to a potential of −110 Volts and the gap between the two surfaces was filled with negatively-charged black electrostatic liquid developer. After the liquid developer was drained from between the surfaces the gap was re-filled with clear Isopar ®-L nonpolar liquid and the potential of the electrode driven to +10 Volts for 10 seconds after which the parallel surfaces were separated by lifting the film supportive plate away from the development electrode and supportive rail assembly.

The resultant toned optically negative image exhibited high uniformity, an absence of background toning, high edge definition, and halftone dot reproduction ranging from 4% to 96% area coverage dots at 150 lines/inch screen ruling.

The black electrostatic liquid developer was prepared using the following procedure: In a Union Process 30-S Attritor, Union Process Company, Akron, Ohio were placed the following ingredients:

| Ingredient | Amount (Kg) |
|---|---|
| Copolymer of ethylene (89%) and methacrylic acid (11%), melt index at 190° C. is 100, acid no. is 66 | 5.94 |
| Sterling ® NS carbon black Cabot Corp., Boston, MA | 0.7695 |
| Heucophthal Blue G XBT-583D Heubach, Inc., Newark, NJ | 0.0405 |
| Isopar ®-L, nonpolar liquid having a Kauri-butanol value of 27, Exxon Corporation | 45 |

The ingredients were heated in the range of 90° to 115° C. and milled with 0.1875 inch (4.76 mm) diameter carbon steel balls for one hour. The attritor was cooled to room temperature while the milling was continued. Milling was continued for an additional 19 hours. The particulate media were removed and Gasic Barium Petronate ®, (Witco Chemical Corp., Sonneborne Division, New York, N.Y.) was added at a level of 30 mg per gram of developer solids. The developer was diluted to 1.5% solids by weight with Isopar ®-L for use as an electrostatic liquid developer.

A 12 inch (30.48 cm)×16 inch (40.64 cm) sample of a photopolymerizable film consisting of metallized polyethylene terephthalate support, photosensitive layer, and a cover sheet, similar to that described in Blanchet-Fincher and Fincher, U.S. Pat. No. 4,849,314 was imagewise exposed for 10 seconds through optically positive halftone and line art films as described in Example 6 above. The sample was then affixed to a mechanized drum fixture wherein the drum surface may be rotated through a sequence of positions bearing functional components for electrostatic processing of films mounted on said surface. The drum was electrically connected to earth ground and the metallic back contact layer of the film sample was connected to the drum. The drum was rotated at 2 inch (5.08 cm) per second surface speed. The film sample travelled past a charging scorotron device with a constant grid potential −120 Volts and a constant wire current of 300 microAmperes with wire potential variable in the range of −4.5 to −5.5 kiloVolts. The negatively charged sample travelled 4 inches (10.16 cm) and entered a two-roll development housing where negatively charged magenta pigmented electrostatic liquid developer, similar to that described in Trout, U.S. Pat. No. 4,707,429, Example 5, was delivered by pump-fed manifolds to fill the 0.006 inch (0.152 mm) gap between the sample surface and the two development electrode rollers which were driven to a potential of −210 Volts and rotating to match the surface speed of the sample. Upon exiting the development housing the toned sample passed through a counter-rotating roller electrode held at +25 Volts and spaced 0.003 inch (0.076 mm) from the sample surface.

The developed sample then was brought into contact with a sheet of 60# basis weight Solitaire ® offset enamel paper (Plainwell Co., Plainwell, Mich.) by the application of a conductive rubber coated roller to the back surface of the paper under the influence of gravity and driven to a constant potential of −3.0 kiloVolts. The paper and sample then passed under a corotron charging device with a constant wire current of 50 microAmperes and a wire potential of approximately +5 kiloVolts. As it exited the corotron device region the paper was stripped away from the photopolymerizable film sample by hand resulting in complete transfer of the toner layer from the sample surface to the paper. The paper sheet was dried in an air oven at 105° C. for one to two minutes to fix the toner image layer to the paper surface. The resultant optically positive magenta image on paper was of high quality, with good uniformity of solid area coverage at 1.34D, low print background density of 0.5D, no density enhancement of feature edges, and halftone dot reproduction of 1% to 97% dot areas based on 150 lines per inch screen ruling.

We claim:

1. A process for reversal development of a latent electrostatic image in a layer on a conductive support by developing with an electrostatic developer having electrostatically charged toner particles comprising in order (a) exposing imagewise to generate permanent persistent areas in the layer having different rates of charge decay and/or charge acceptance, (b) charging the layer, (c) allowing formation of an electrostatic image corresponding to the exposed imagewise generated areas by differential charge decay and/or charge acceptance, (d) creating an electrical field to attract toner particles preferentially to the areas of lesser charge, and (e) developing the areas of lesser charge with electrostatically charged toner particles having the same polarity as that of the charged layer.

2. A process according to claim 1 wherein the layer on the conductive support is a photohardenable layer.

3. A process according to claim 2 wherein the layer is photopolymerizable.

4. A process according to claim 1 wherein the layer on the conductive support is a wash-out photohardenable layer.

5. A process according to claim 1 wherein the layer on the conductive support is a leuco dye-containing photosensitive layer.

6. A process according to claim 1 wherein the layer on the conductive support is a silver halide-based photosensitive layer.

7. A process according to claim 6 wherein the silver halide-based layer consists essentially of a silver halide photographic salt dispersed in a synthetic insulating polymeric binder that is swellable in aqueous solutions having a pH greater than about 8½.

8. A process according to claim 1 wherein the layer on the conductive support is a silver halide-based layer prepared from a diffusion transfer film comprising development nuclei dispersed in a synthetic insulating polymeric binder that is swellable in aqueous solutions having a pH greater than about 8½.

9. A process according to claim 1 wherein the exposed layer is charged by corona discharge.

10. A process according to claim 1 wherein the charged layer having imagewise areas having different rates of charge decay is allowed to stand for 0.001 to 10 minutes to form an electrostatic image corresponding to the imagewise generated areas.

11. A process according to claim 1 wherein the charged layer having imagewise areas having different rates of charge decay is allowed to stand for 0.01 to 0.25 minute to form an electrostatic image corresponding to the imagewise generated areas.

12. A process according to claim 1 wherein the imagewise generated areas having different rates of charge acceptance are charged and an electrical field is immediately created to attract toner particles preferentially to the areas of lesser charge.

13. A process according to claim 1 wherein the electrical field to attract toner particles preferentially to the areas of lesser charge is created by providing a voltage on the development electrode or the conductive backing of the electrostatic element that is less than the potential in the charge retaining areas of the electrostatic element.

14. A process according to claim 1 wherein the developing is accomplished with a dry electrostatic toner.

15. A process according to claim 1 wherein the developing is accomplished with a liquid electrostatic developer.

16. A process according to claim 15 wherein the liquid electrostatic developer consists essentially of (a) a nonpolar liquid having a Kauri-butanol value of less than 30, present in a major amount, (b) thermoplastic resin particles having an average by area particle size of less than 10 μm, and (c) a nonpolar liquid soluble charge director compound.

17. A process according to claim 1 wherein the developed image is transferred to a receptor support.

18. A process according to claim 16 wherein the developed image is transferred to a receptor support.

19. A process according to claim 17 wherein the receptor support is paper.

20. A process according to claim 18 wherein the receptor support is paper.

21. A process according to claim 17 wherein the transfer is accomplished by electrostatic means.

22. A process according to claim 18 wherein the transfer is accomplished by electrostatic means.

23. A process according to claim 3 wherein the photopolymerizable layer comprises of an organic polymeric binder, at least one compound having at least one ethylenically unsaturated group, and a photoinitiator.

24. A process according to claim 23 wherein the photopolymerizable layer contains a chain transfer agent.

25. A process according to claim 23 wherein the photopolymerizable layer contains an organic compound selected from the group consisting of at least one organic electron donor, at least one organic electron acceptor, and a substituted aromatic amino compound with or without a strong acid.

26. A process according to claim 23 wherein the exposed photopolymerizable layer is charged by corona discharge.

27. A process according to claim 23 wherein the developing is accomplished with a dry electrostatic developer.

28. A process according to claim 23 wherein the developing is accomplished with a liquid electrostatic developer.

29. A process according to claim 28 wherein the liquid electrostatic developer consists essentially of (a) a nonpolar liquid having a Kauri-butanol value of less than 30, present in a major amount, (b) thermoplastic resin particles having an average by area particle size of less than 10 μm, and (c) a nonpolar liquid soluble charge director compound.

* * * * *